US011443680B1

(12) United States Patent
Chan et al.

(10) Patent No.: US 11,443,680 B1
(45) Date of Patent: Sep. 13, 2022

(54) FRAME RATE-CONVERTIBLE ACTIVE MATRIX DISPLAY

(71) Applicant: Solomon Systech (Shenzhen) Limited, Shenzhen (CN)

(72) Inventors: Wing Chi Stephen Chan, Hong Kong (HK); Chi Wai Lee, Hong Kong (HK); Wai Hon Ng, Hong Kong (HK); Chen Jung Chuang, Hong Kong (HK)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 0 days.

(21) Appl. No.: 17/565,487

(22) Filed: Dec. 30, 2021

(30) Foreign Application Priority Data

Sep. 30, 2021 (CN) ..... 202111168594.3

(51) Int. Cl.
*G09G 3/20* (2006.01)

(52) U.S. Cl.
CPC ... *G09G 3/2044* (2013.01); *G09G 2320/0242* (2013.01); *G09G 2320/0261* (2013.01); *G09G 2320/106* (2013.01); *G09G 2340/0435* (2013.01)

(58) Field of Classification Search
CPC ..... G09G 3/2044; G09G 2320/0242; G09G 2320/0261; G09G 2320/016; G09G 2340/0435
See application file for complete search history.

(56) References Cited

U.S. PATENT DOCUMENTS

| | | | | |
|---|---|---|---|---|
| 10,210,788 | B2 * | 2/2019 | Su | G09G 3/2074 |
| 2006/0139696 | A1 * | 6/2006 | Yamamoto | H04N 19/90 375/E7.092 |
| 2007/0116367 | A1 * | 5/2007 | Yamamoto | H04N 1/4105 382/232 |
| 2015/0235587 | A1 * | 8/2015 | Su | G09G 3/2003 345/694 |
| 2018/0254020 | A1 * | 9/2018 | Buckley | G09G 3/344 |
| 2019/0073754 | A1 * | 3/2019 | Chen | G09G 5/04 |

* cited by examiner

*Primary Examiner* — Ricardo Osorio
(74) *Attorney, Agent, or Firm* — Idea Intellectual Limited; Margaret A. Burke; Sam T. Yip

(57) ABSTRACT

The present invention provides a dithering and directional modulation-based frame rate conversion apparatus comprising: a directional delta modulation generator configured to receive a plurality of input color data representing a plurality of input color components of an input pixel color and generate a plurality of modulated data for the plurality of input color data respectively; and a plurality of dithering modules configured to perform K-bit dithering conversion on the plurality of input color data respectively to generate a plurality of output color data for representing a plurality of output color components of an output pixel color with a color depth of K bits per component, where K is an integer equal to or great than 1. The present invention can allow display to support frame rates higher than its standard configuration without observable color depth degradation.

19 Claims, 17 Drawing Sheets

200Hz frame rate at color depth of 8 bits per component

150Hz frame rate at color depth of 8 bits per component

100Hz frame rate at color depth of 8 bits per component

80Hz frame rate at color depth of 8 bits per component

VS1

VS3

FRAME RATE-CONVERTIBLE ACTIVE MATRIX DISPLAY

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

The present application claims priority from the Chinese Invention Patent Application Nos. 202111168594.3 filed on Sep. 30, 2021, and the disclosure of which is incorporated herein by reference in its entirety.

FIELD OF THE INVENTION

The present invention is generally related to active matrix display devices. More particularly, the present invention is related to frame rate-convertible active matrix display devices based on digital driving signals.

BACKGROUND

There are always desires for display devices capable of displaying smooth and true color videos for various types of video contents and image sources. In general, an active matrix display includes pixels and each pixel includes a driver circuit comprising switching elements such as transistors and storage elements such as capacitor for actively addressing the pixel and maintaining the pixel state. Typically, the pixels are selected row by row by a gate driver through a plurality of scan lines and then each pixel at the selected row is controlled by a source driver through a corresponding data line to emit light for displaying an image.

Active matrix display devices may be driven with analog or digital driving signals. In the analogy approach, brightness of a pixel is controlled with analog signals such as voltage or current levels of the driving signal, whereas in the digital approach, brightness of a pixel is controlled with pulse width of the driving signal. The digital approach has been gaining popularity over the analogy approach as it can use digital video signals directly for pixel driving therefore requires relatively simple driver circuits and has less power consumption. It has also better luminance uniformity because the display quality is less sensitive to variances in current-voltage characteristics of the transistors in pixel driver circuits.

In the digital modulation approach, image frame for each pixel is divided into a number of sub-frames each corresponds to a bit in the digital image data to be displayed. The subframes may have different durations which are weighted according to positions of bits to be represented respectively and under a rule that the more significant bit the subframe represents the longer the subframe duration is.

For each sub-frame, each row of pixels is scanned for a scan time. Pixels of the scanned row are then controlled to emit at a fixed luminance (turned ON) or zero luminance (turned OFF) to represent a logical value of "1" or "0" respectively and hold the state over the subframe duration.

As such, a gray level scale of $2^k$ levels can be achieved by means of aggregation of a hold time over which the pixel is turned ON within each frame.

Conventionally, the scan lines are scanned sequentially in each subframes and the sub-frames are arranged sequentially in an ascending/descending order and repeated cyclically. However, in order to accomplish high display resolution or dynamic range, the scanning speed may not high enough such that the scanning cannot be completed before start of next frame. If the scan time of the present frame is longer than the period of a last subframe and overruns into the first subframe of the next frame, there are two scan lines in operation concurrently over the first subframe of the next frame.

Under a limited display capability, good balance between color depth and frame rate is required to achieve optimal display quality. For example, for a display device with a standard configuration of color depth of 24 bits at 60 Hz frame rate which is adequate for most general applications, it may be better to display fast moving objects at higher frame rates (e.g., 120 Hz) to avoid motion blur but a lower color depth (e.g., 12-bit) will be resulted. The reduction of color depth may cause inaccurate color presentation such as color banding in images. For example, when an image originally displayed at color depth of 8 bits per component as shown in FIG. 1A is displayed at color depth of 3 bits per component as shown in FIG. 1B, observable color banding is caused in some areas. Therefore, it is desirable to enable a display device to support frame rates higher than its standard configuration without observable color depth degradation.

SUMMARY OF THE INVENTION

According to one aspect of the present invention, a dithering and directional modulation-based frame rate conversion apparatus is provided. The apparatus comprises: a directional delta modulation generator configured to receive a plurality of input color data representing a plurality of input color components of an input pixel color and generate a plurality of modulated data for the plurality of input color data respectively; and a plurality of dithering modules configured to perform K-bit dithering conversion on the plurality of input color data respectively to generate a plurality of output color data for representing a plurality of output color components of an output pixel color with a color depth of K bits per component, where K is an integer equal to or great than 1. Each of the dithering modules comprising: a residue line buffer configured to track a residual error in dithering conversion to generate a respective residual data; an adapter configured to receive a respective input color data, a respective modulated data from the directional delta modulation generator and the respective residual data, and adapt the respective input color data to generate a respective adapted color data by adding the respective input color data with the respective modulated data and the respective residual data; and a dithering engine configured to receive the respective adapted color data and compare the respective adapted color data against a $(2^K-1)$ number of dithering threshold values to generate a respective output color data with $2^K$ possible color levels.

According to another aspect of the present invention, a dynamic motion detection method for detecting motion content in a video to be displayed by a display device is provided. The method comprises: detecting, by a dynamic motion detection apparatus, motion content of the video and generating, by the dynamic motion detection apparatus, a motion detection result; receiving, by a frame rate controller, the motion detection result; and generating, by the frame rate controller, a control signal for controlling a display color depth based on the motion detection result. The video is displayed with a lower color depth at a higher frame rate than a standard configuration of the display device if the motion detection result indicates that the video contains appreciable amount of motion content; and the video is displayed with a higher color depth at a lower frame rate than the standard configuration of the display device if the motion detection result indicates that the video is relatively static.

By applying directional modulation before performing K-bit dithering conversion on input color data to generate output color data with a color depth of K bits per component, the display device can support frame rates higher than its standard configuration without observable color depth degradation. As shown in FIG. 1C, by implementing frame rate conversion provided by the present invention to reduce color depth of an image from 8 bits per component to 3 bits per component, the color banding due to the color depth reduction can be smoothened significantly. Moreover, by facilitating the display device to dynamically convert its display output formats according to motion content of the video, the display quality can be further optimized.

BRIEF DESCRIPTION OF THE DRAWINGS

Embodiments of the invention are described in more details hereinafter with reference to the drawings, in which.

DETAILED DESCRIPTION OF THE INVENTION

In the following description, methods for driving an active matrix display for frame-rate conversion and the display device for implementing the same are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1A:
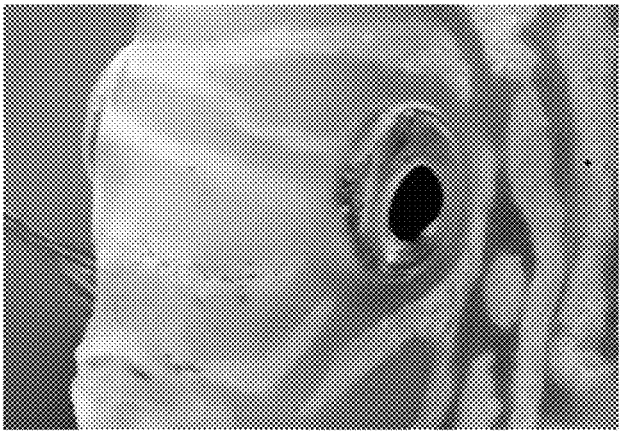
FIG. 1A shows an image originally displayed at color depth of 8 bits per component.
Figure 1B:
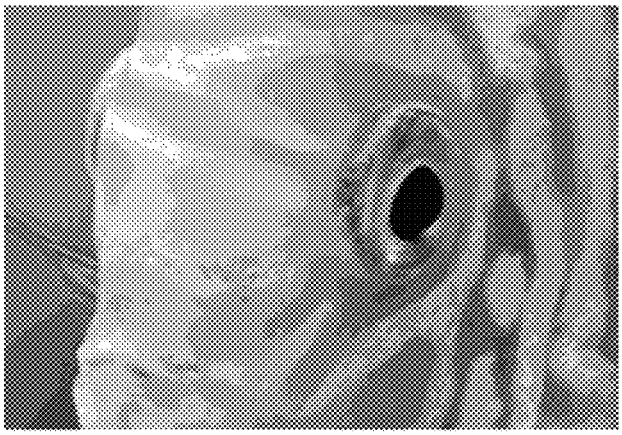
FIG. 1B shows a color-reduced image at color depth of 3 bits per component.
Figure 1C:
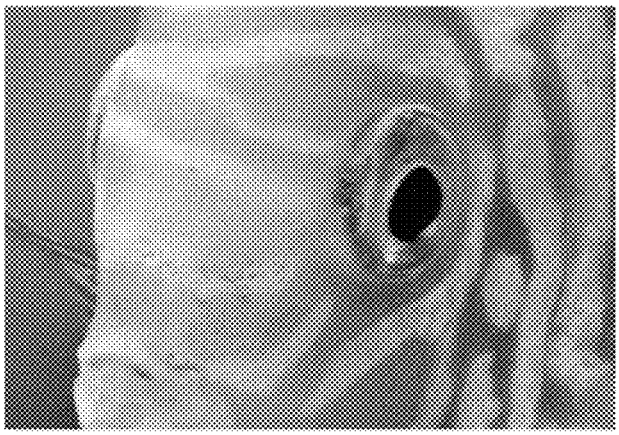
FIG. 1C shows the color-reduced image (at color depth of 3 bits per component) improved with the driving method provided by the present invention.
Figure 2:
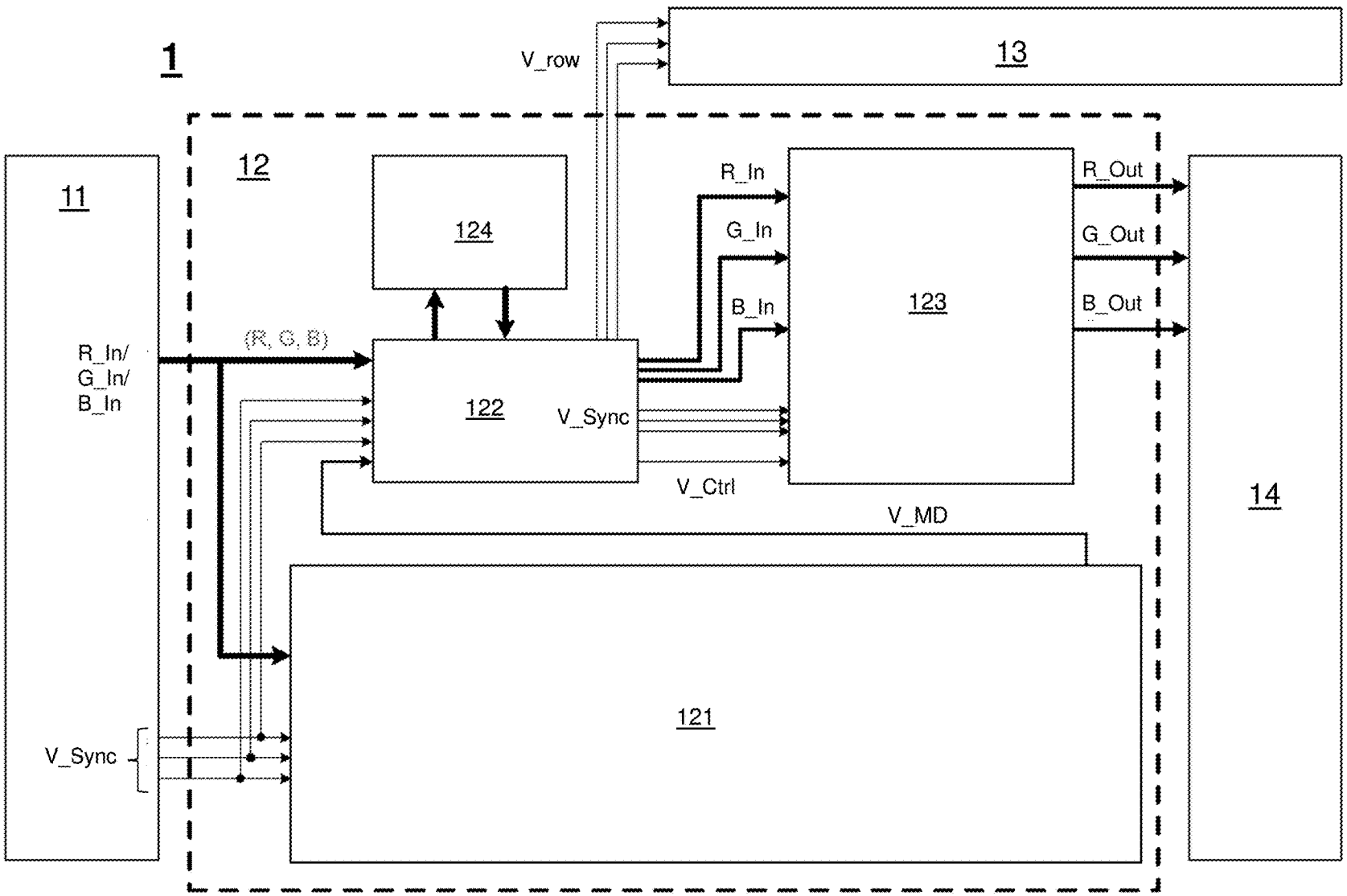
FIG. 2 shows a simplified system block diagram of a frame rate-convertible active matrix display device according to one embodiment of the present invention.

FIG. 2 shows a simplified system block diagram of a frame rate-convertible active matrix display device 1 according to one embodiment of the present invention. Referring to FIG. 2, the display device 1 may include a host processor 11; a timing controller 12 connected to the host processor 11; a gate driver 13 connected between the timing controller 12 and an active matrix display panel (not shown); a source driver 14 connected between the timing controller 12 and the active matrix display panel. The host processor 11 may be configured to generate a plurality of input color data (R_In/G_In/B_In) for representing RGB color components of input color data and a synchronization signal (V_Sync). The timing controller 12 may be configured to receive the plurality of input color data and synchronization data and generate a plurality of output color data (R_Out/G_Out/B_Out) to the source driver 14 and a plurality of row selection signals (V_row) to the gate driver 13.

The timing controller 12 may comprise a dynamic motion detection apparatus 121 configured to detect motion content of a video and generate a motion detection signal (V_MD); a frame rate controller 122 configured to receive the motion detection result and the input color data, and generate a control signal (V_Ctrl) for controlling a display color depth, a dithering and directional modulation-based frame rate conversion apparatus 123 configured to receive the control signal and convert the input color data to the output color data based on directional modulation and dithering such that the video can be displayed without observable color depth degradation even if the display frame rate is higher than the standard configuration of the display device. The timing controller 12 may further comprise a frame buffer 124 connected to the frame rate controller 122 and configured to store color data.

In particular, if the motion detection result for the video indicating that the video contains appreciable amount of motion content, the display device will display the video with a lower color depth (e.g., 4 bits per color components) at a higher frame rate (e.g. 120 Hz) than a standard configuration of the display device. If the motion detection result indicating that is the video is relatively static, the display device will display the video with a higher color depth (e.g., 8 bits per color component) at a lower frame rate (e.g. 60 Hz) than the standard configuration of the display device.

Figure 3:
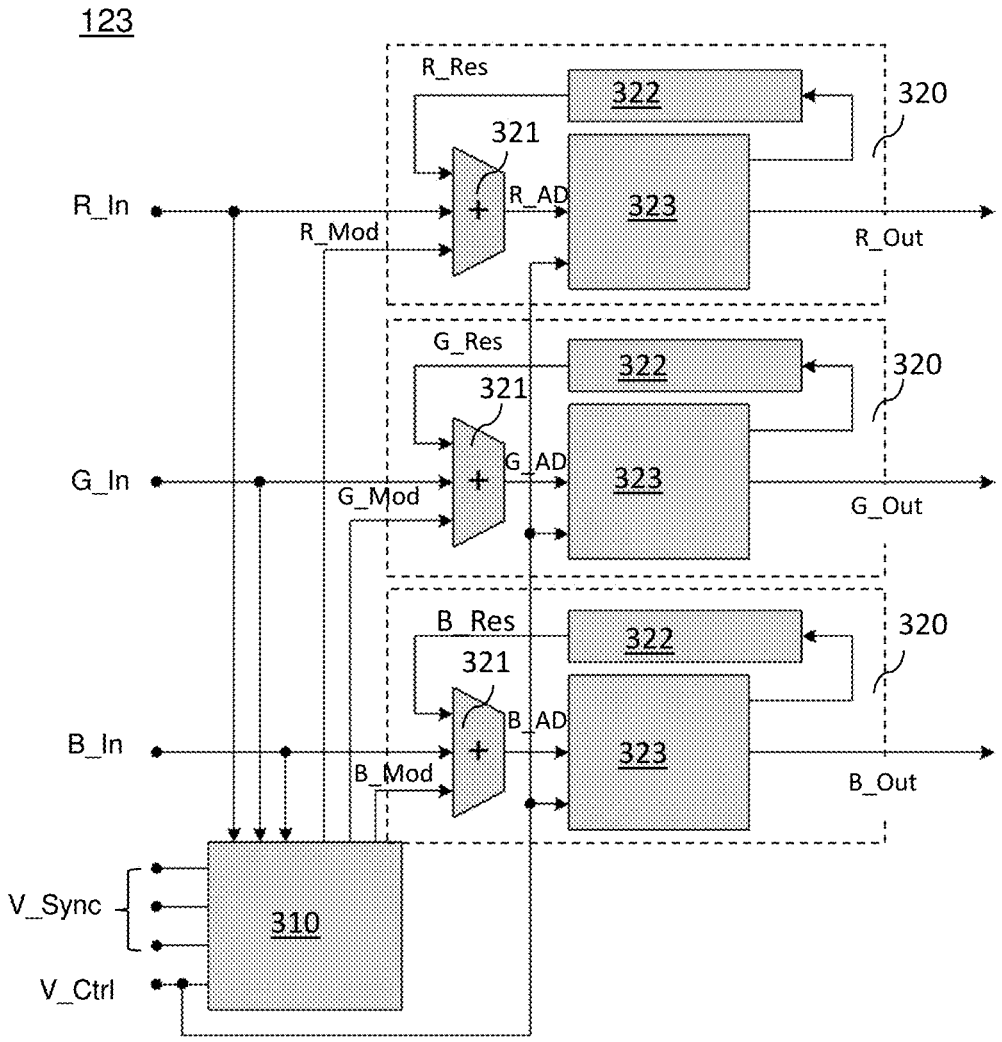
FIG.3 depicts a block diagram of a dithering and directional modulation-based frame rate conversion apparatus according to one embodiment of the present invention.

FIG.3 depicts a block diagram of a dithering and directional modulation-based frame rate conversion apparatus 123 according to one embodiment of the present invention. Referring to FIG. 3, the dithering and directional modulation-based frame-rate conversion apparatus 123 may comprise a directional delta modulation generator 310 and a plurality of dithering modules 320.

The directional delta modulation generator 310 may be configured to receive a plurality of input color data (R_In, G_In and B_In) representing RGB color components of an input pixel color, a plurality of synchronization signals (V_Sync) and a control signal (V_Ctrl); and generate a plurality of modulated data (R_Mod, G_Mod and B_Mod) for the plurality of input color data respectively.

Each dithering module 320 may comprise a respective residue line buffer 322 configured to track a residual error in dithering conversion and generate a respective residual data (R_Res/G_Res/B_Res); and a respective adapter (or adder) 321 configured to receive a respective input color data (R_In/G_In/B_In), a respective modulated data (R_Mod/G_Mod /B_Mod) from the directional delta modulation generator 310, and a respective residual data (R_Res/G_Res/B_Res) from a respective residue line buffer 322 to adapt the respective input color data to generate a respective adapted color data (R_AD/G_AD/B_AD) by adding the respective input color data with the respective modulated data and the respective residual data.

Each dithering module 320 may further comprise a dithering engine 323 configured to receive a respective adapted color data (R_AD/G_AD /B_AD) from a respective adapter and generate a respective output color data (R_Out/G_Out/B_Out).

Depending on the frame-rate conversion target, each dithering engine 323 may be configured to perform K-bit dithering to convert the respective adapted color data to an output color data for representing a color depth of K bits per component, where K is an integer equal to or great than 1 which may be selected by the control signal (V_ctrl) from the frame rate controller 122. In particular, the respective adapted color data is compared against $(2^K-1)$ dithering threshold values to generate a respective output color data with $2^K$ possible output color levels.

Figure 4A:
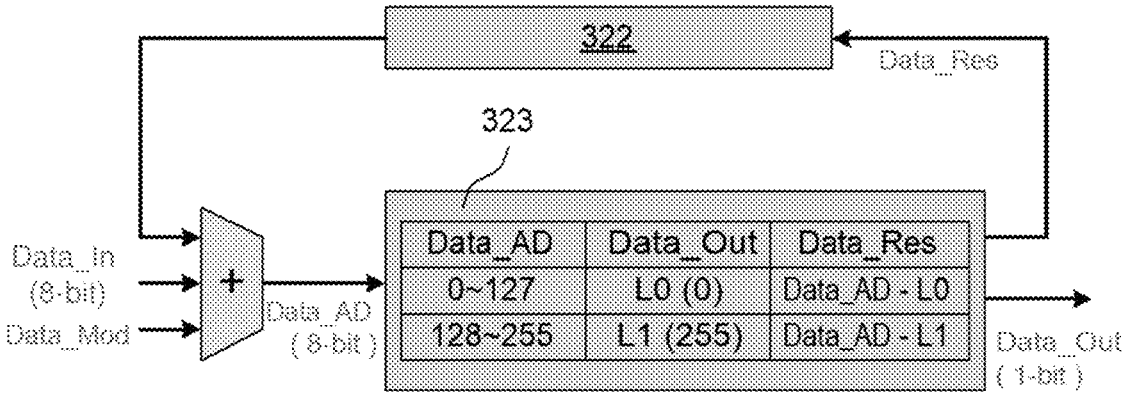
FIG. 4A shows how an input color with a color depth of 8 bits per component is converted an output color with a color depth of 1 bit per component.

As shown in FIG. 4A, for converting an adapted color data (Data_AD) adapted from an input color data (Data_in) with a color depth of 8 bits per component to an output color data (Data_Out) with a color depth of 1 bit per component, the dithering engine 323 may be configured to perform 1-bit dithering to output two possible output color levels, $L_0$ and $L_1$ , which may be set to have color values of 0 and 255, respectively. The adapted color data, which may have 256 possible color levels (0, 1, . . . to 255) is compared against one dithering threshold value (e.g., 128) to determine an output color level for the output color data. For example, when the adapted color data has a value of 87, which is smaller than the dithering threshold value 128, the dithering engine 323 outputs $L_0$ (i.e., color value of "0") for the output color data, and stores a residual data (Data_Res) equal to 87−0=87 into the residue line buffer 322 which will be used for dithering the input color of neighboring pixels.

Figure 4B:
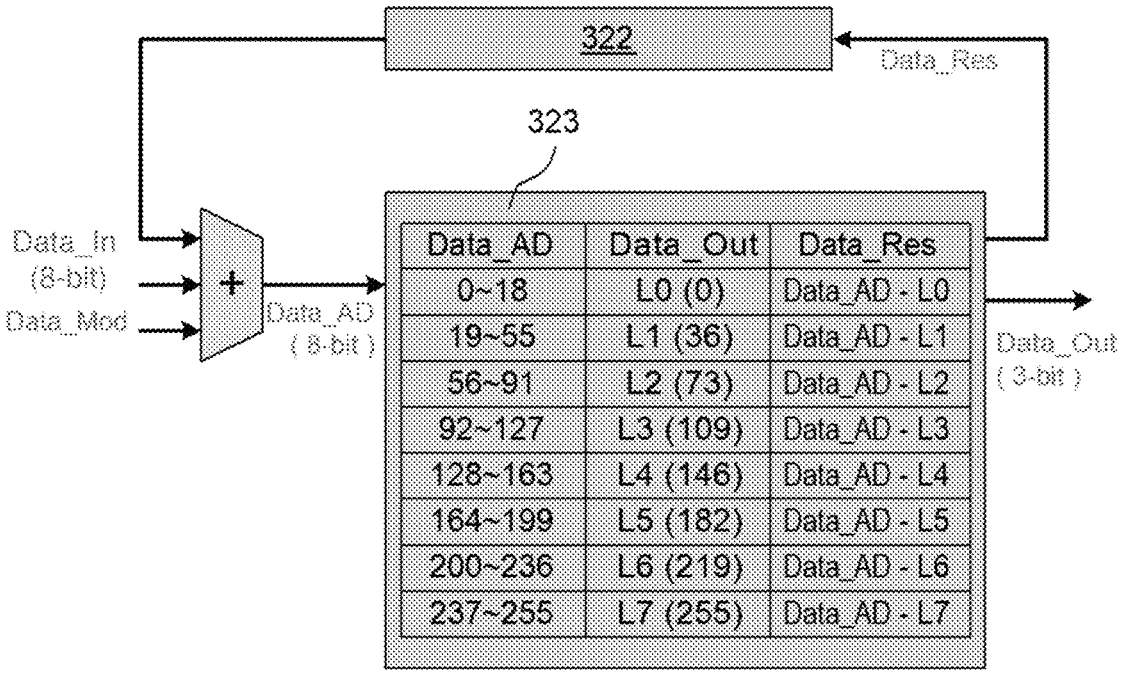
FIG. 4B shows how an input color with a color depth of 8 bits per component is converted an output color with a color depth of 3 bits per component.

As shown in FIG. 4B, for converting an adapted color data (Data_AD) adapted from an input color data (Data_in) with a color depth of 8 bits per component to an output color data (Data_Out) with a color depth of 3 bits per component, the dithering engine 323 may be configured to perform 3-bit dithering to output eight possible output color levels, $L_0$ through $L_7$, which may be set to have color values of 0, 36, 73, . . . 255, respectively. The adapted color data, which may have 256 possible color levels (0, 1, . . . to 255) is compared against seven dithering threshold values (e.g., 18, 55, 91, . . . , 236) to determine an output color level for the output color data. For example, when the adapted color data has a value of 173, which is in the range between 164~199, the dithering engine 323 outputs $L_5$ (i.e., color value of "182") for the output color data, and stores a residual data (Data_Res) equal to 173−182=−9 into the residue line buffer 322 which will be used for dithering the input color of neighboring pixels.

A color space cube for representing the pixel color may be divided into a number of sub-color space cubes depending on the color depth to be displayed. For instance, in a RGB color space, with a color depth of K bits per component in each RGB direction, a color space cube may be divided into an $8^K$ number of sub-color space cubes and there are K number of quantized color levels in each RGB direction. Accordingly, each sub-color space cube corresponds to a set of RGB color levels.

Figure 5A:
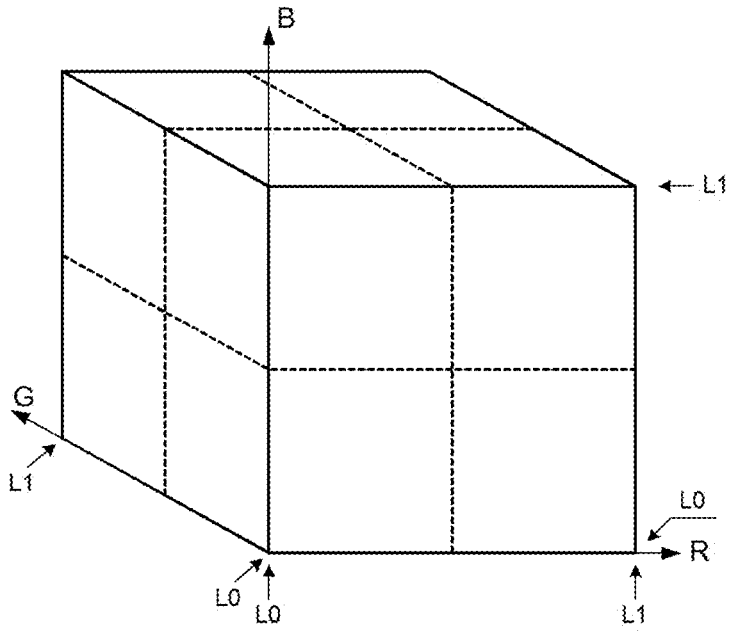
FIGS. 5A-5C depicts how the color space is divided based on different color depths.
Figure 5B:
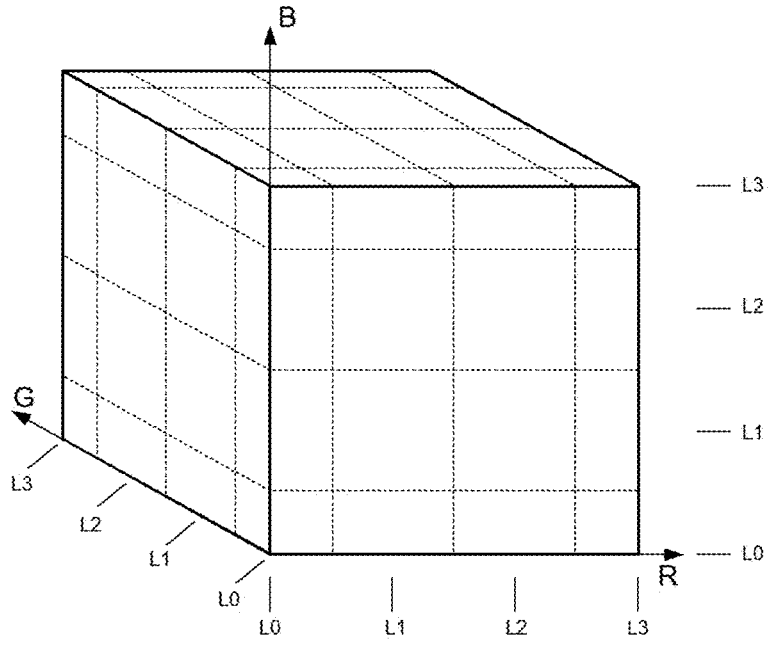
Figure 5C:
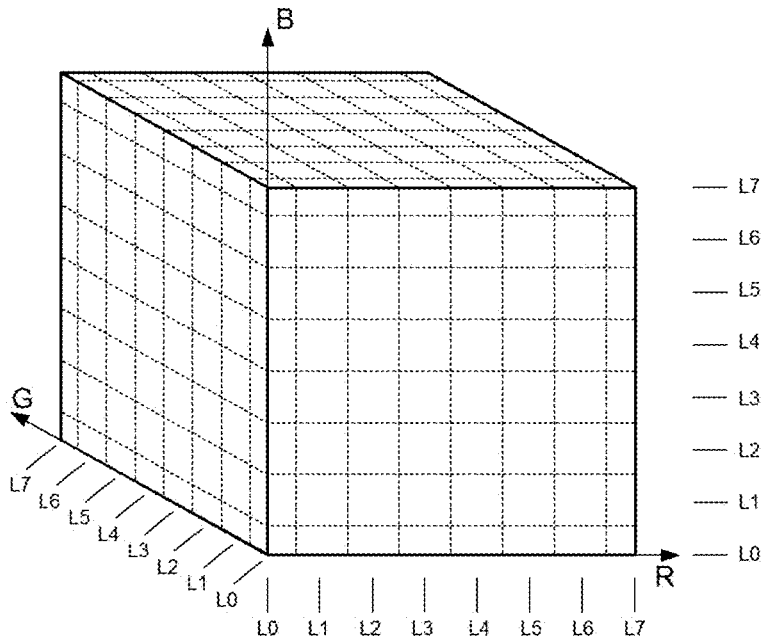

FIGS. 5A-5C depicts how the color space is divided based on different color depths. Referring to FIG. 5A, for a color depth of 1 bit per component, the color space cube is divided into 8 sub-color space cubes and there are two color levels ($L_0$ and $L_1$) for representing the pixel color in each of the RGB components. Referring to FIG. 5B, for a color depth of 2 bits per component, the color space cube is divided into 64 sub-color space cubes and there are four color levels ($L_0$ through $L_3$) for representing the pixel color in each of the RGB components. Referring to FIG. 5C, for a color depth of 3 bits per component, the color space cube is divided into 512 sub-color space cubes and there are eight color levels ($L_0$ through $L_7$) for representing the pixel color in each of the RGB components. It can be seen that the small number of bits the color depth to be displayed, the smaller number of color levels available for representing the pixel color in each of the RGB components and the more resolution errors will be lost due to high quantization errors.

The directional delta modulation generator 310 may be further configured to determine a modulation direction by comparing each of the color components of the pixel color against a modulation threshold value and obtaining a flag value of modulation for each of the color components. For instance, if a color component of the pixel has a value equal to or greater than the modulation threshold value, the flag value of modulation for the color component is set as "1", otherwise, the flag value of modulation for the color component is set as "0".

Accordingly, the flag values of modulation for each of the color components may be used to construct a modulation direction unit vector $U_m$ $(x_m, y_m, z_m)$ in the RGB color space to represent the modulation direction, where $x_m$, $y_m$, and $z_m$ are RGB components of the unit vector respectively. Each of the RGB components $x_m$, $y_m$, and $z_m$ of the modulation direction unit vector $U_m$ may have a binary value ("1" or "0") determined by comparing RGB component values of the pixel color against with the modulation threshold value respectively. For instance, if the R component value of the pixel color is equal to or greater than the modulation threshold value, $x_m$ is set to "1", otherwise $x_m$ is set to be "0". In other words, whether delta modulation is applied in a color component (direction) in the color space depends on whether the component value of the pixel color in that color component (direction) is equal to or greater than the modulation threshold value.

FIGS. 6A-6G illustrate some exemplary delta modulation directions determined by setting the modulation threshold value as a half of the maximum component value of RGB components within a pixel, M.

Figure 6A:
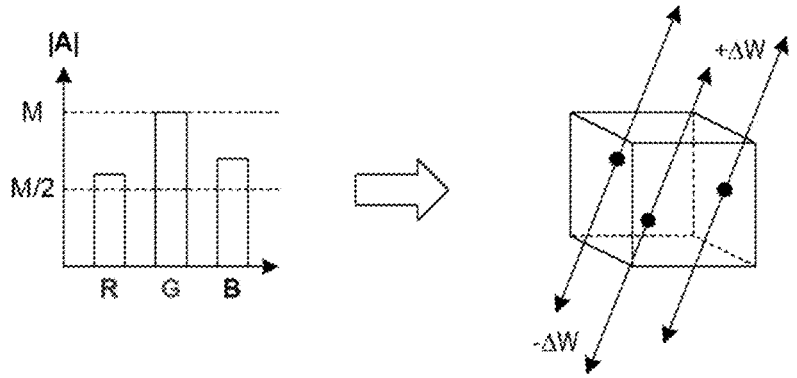
FIGS. 6A-6G illustrate some exemplary delta modulation directions determined by setting the modulation threshold value as a half of the maximum component value of a pixel color.

Referring to FIG. 6A, when all of R, G, and B component values of the pixel are equal to or greater than M/2, the RGB components $x_m$, $y_m$, and $z_m$ of the modulation direction unit vector $U_m$ are all equal to "1". Therefore, delta modulation direction is in the white (ΔW) direction.

Figure 6B:
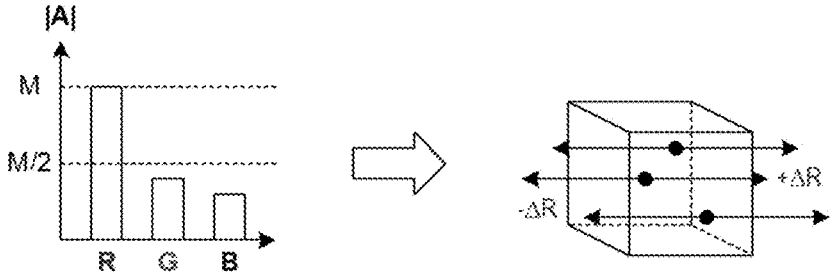

Referring to FIG. 6B, when the R component value of the pixel is equal to or greater than M/2 and both of the G and B component values of the pixel are smaller than M/2, the RGB components $x_m$, $y_m$, and $z_m$ of the modulation direction unit vector $U_m$ are equal to "1", "0", and "0", respectively. Therefore, delta modulation direction is in the red (ΔR) direction.

Figure 6C:
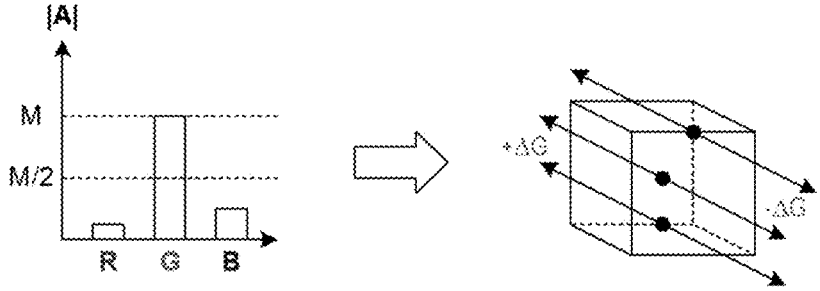

Referring to FIG. 6C, when the G component value of the pixel is equal to or greater than M/2 and both of the R and B component values of the pixel are smaller than M/2, the RGB components $x_m$, $y_m$, and $z_m$ of the modulation direction unit vector $U_m$ are equal to "0", "1", and "0", respectively. Therefore, delta modulation direction is in the green (ΔG) direction.

Figure 6D:
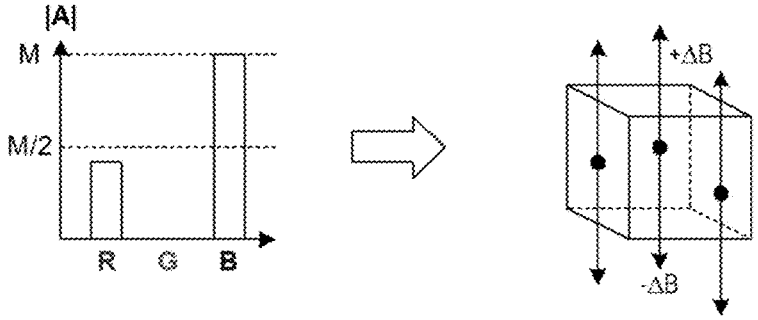

Referring to FIG. 6D, when the B component value of the pixel is equal to or greater than M/2 and both of the R and G component values of the pixel are smaller than M/2, the RGB components $x_m$, $y_m$, and $z_m$ of the modulation direction unit vector $U_m$ are equal to "0", "0", and "1", respectively. Therefore, delta modulation direction is in the blue (ΔB) direction.

Figure 6E:
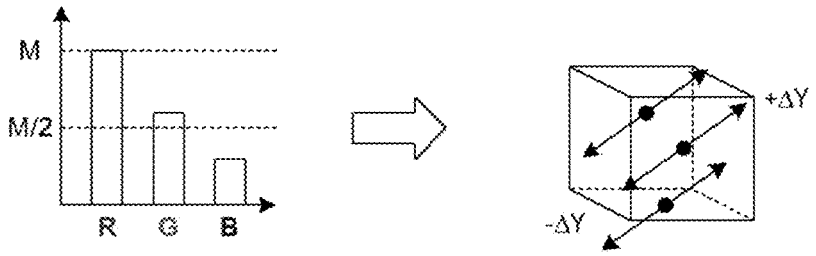

Referring to FIG. 6E, when both of the R and G component values are greater than or equal to M/2 and the B component value is smaller than M/2, the RGB components $x_m$, $y_m$, and $z_m$ of the modulation direction unit vector $U_m$ are equal to "1", "1", and "0", respectively. Therefore, delta modulation direction is in the yellow (ΔY) direction.

Figure 6F:
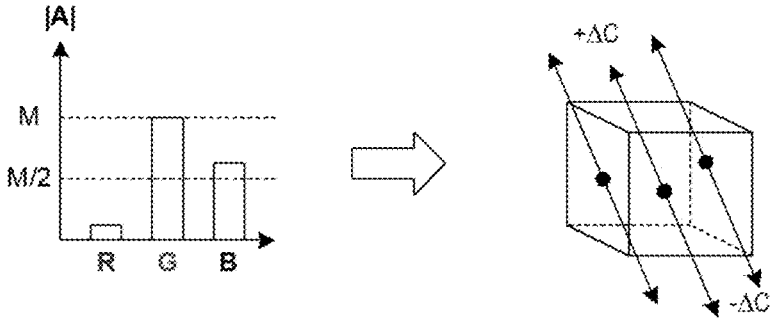

Referring to FIG. 6F, when both of the G and B component values are greater than or equal to M/2 and the R component value is smaller than M/2, the RGB components $x_m$, $y_m$, and $z_m$ of the modulation direction unit vector $U_m$ are equal to "0", "1", and "1", respectively. Therefore, delta modulation direction is in the cyan (ΔC) direction.

Figure 6G:
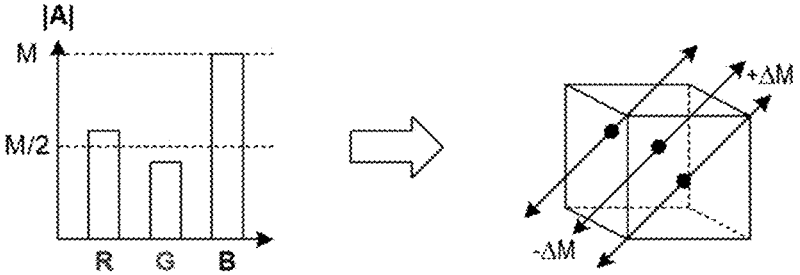

Referring to FIG. 6G, when both of the B and R component values are greater than or equal to M/2 and the G component value is smaller than M/2, the RGB components $x_m$, $y_m$, and $z_m$ of the modulation direction unit vector $U_m$ are equal to "1", "0", and "1", respectively. Therefore, delta modulation direction is in the magenta (ΔM) direction.

The directional delta modulation generator 310 may be further configured to apply a delta modulation based on the determined flag value to each of the color components of the pixel to obtain a modulated data for the color component.

The delta modulation may be performed across a sequence of image frames over a modulation cycle using a sequence of N delta modulation values to obtain N modulated data for each of the color components. Within the modulation cycle, an $i^{th}$ modulated data for the color component obtained in the $i^{th}$ frame may be given by:

$$X_{mi}=X_{oi}+d_i, \text{ for } i=1, 2, \ldots, N,$$

where $X_{mi}$ is the $i^{th}$ modulated data obtained in the $i^{th}$ frame, $X_{oi}$ is the original value of the input color data in the $i^{th}$ frame, $d_i$ is the delta modulation value used in the $i^{th}$ frame which may have a positive or negative value, and N is the total number of frames within a modulation cycle.

Preferably, the sequence of N delta modulation values $d_i$, may be selected to have a sum equal to zero, that is, $\Sigma_{i=1}^{N} d_i=0$, in order to apply the delta modulation across the frames in a balanced manner.

Within the modulation cycle, the dithering engine 323 may be further configured to determine a N number of color levels for the color component of the pixel based on the Nmodulated data obtained across the N number of frames respectively.

The $i^{th}$ color level for the color component based on the modulated data $X_{mi}$ obtained in the $i^{th}$ frame may be determined with an algorithm given by:

$$C_i = \begin{cases} L_{K-1}, \text{ if } X_{mi} < \dfrac{L_K + L_{K-1}}{2} \\ L_k, \text{ if } \dfrac{L_k + L_{k-1}}{2} < X_{mi} < \dfrac{L_{k+1} + L_k}{2} \\ L_{K+1}, \text{ if } X_{mi} > \dfrac{L_{K+1} + L_K}{2} \end{cases},$$

where $C_i$ is the $i^{th}$ color level obtained in the $i^{th}$ image frame, $L_k$ is the $k^{th}$ color levels defined in the color space with the color depth of K bits per component to be displayed.

The dithering engine 323 may be further configured to average the N color levels for the color components of the pixel determined across the sequence of frames over the modulation cycle to obtain an average display color value $C_{avg}$, which is given by:

$$C_{avg} = \frac{1}{N}\sum_{i=1}^{N} C_i;$$

and set the average display color value as the output color level.

Figure 7A:
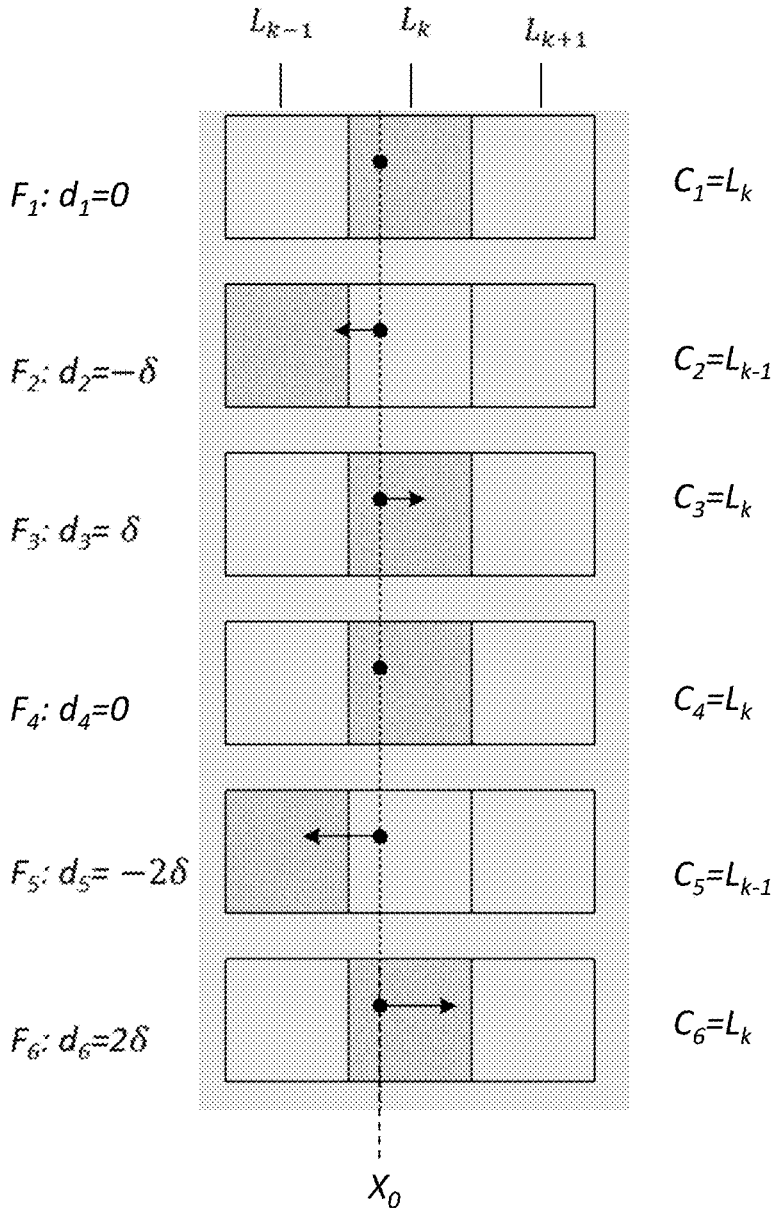
FIGS. 7A-7C illustrate how the modulation is applied and how the color level is determined for a color data of the pixel within a modulation cycle.
Figure 7B:
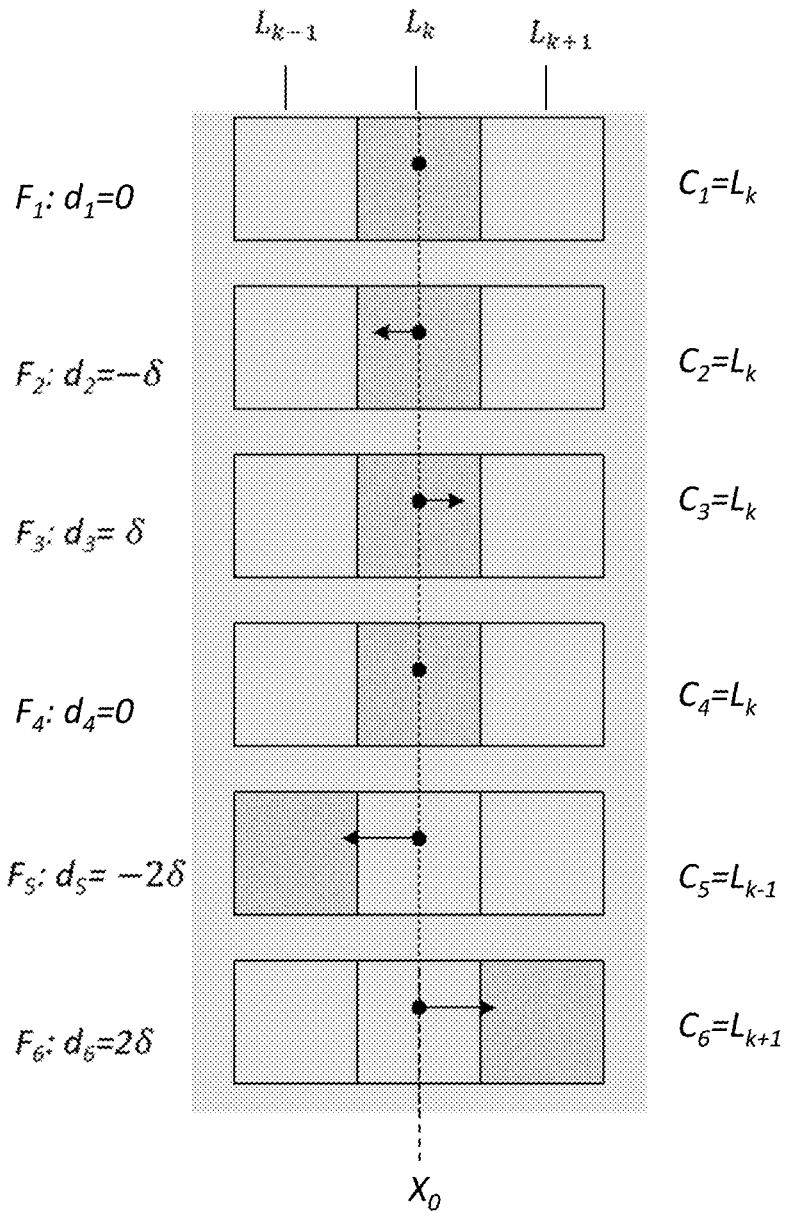
Figure 7C:
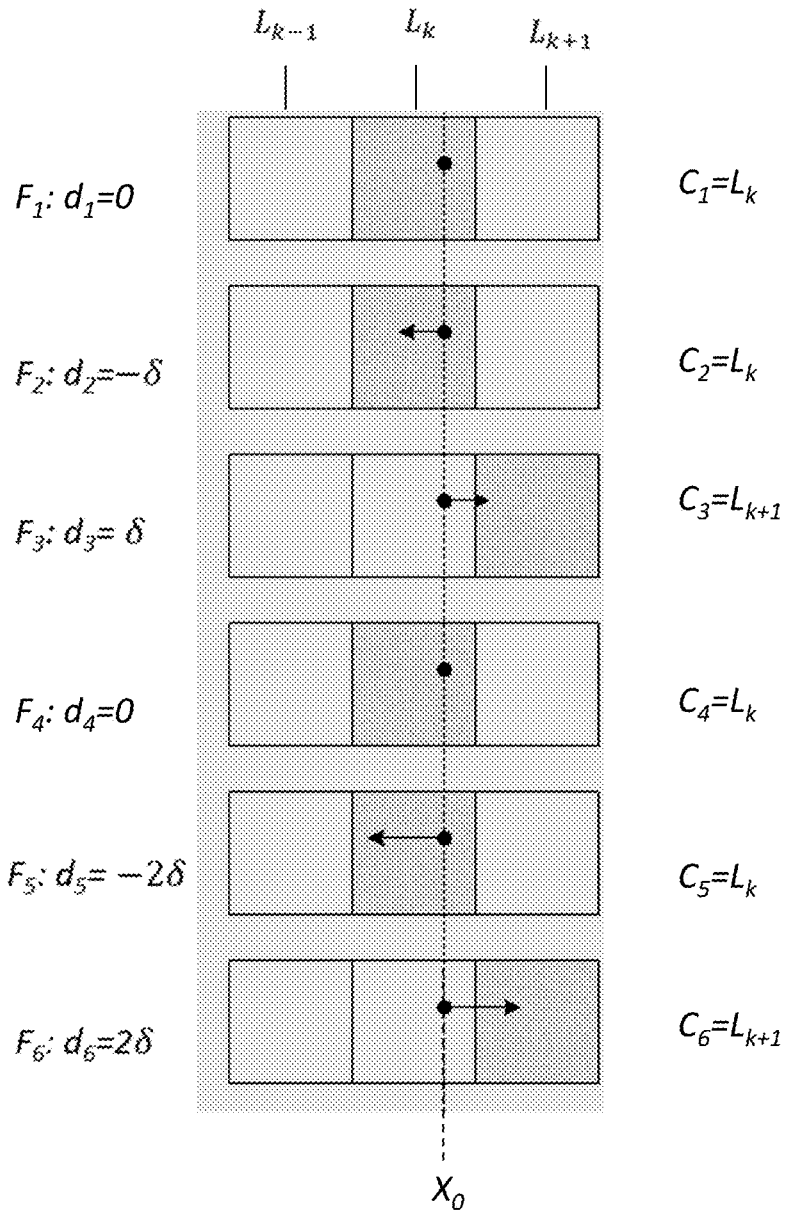

FIGS. 7A-7C illustrate how the modulation is applied and how the color level is determined for a color component of the pixel within a modulation cycle of 6 frames ($F_1$ to $F_6$) in three different cases. For simplicity, the three-dimensional (3D) sub-color space cubes are reduced to two-dimensional (2D) sub-color space squares arranged in the direction of the color component such that each sub-color space square corresponds to a corresponding color level in that direction. Moreover, only three sub-color space squares, namely $L_{k-1}$, $L_k$, and $L_{k+1}$, are shown for each frame as the modulation will cause the color component of the pixel to transit between adjacent color levels only and it is assumed that the color component of the pixel has a value $X_0$ between $$\frac{L_k + L_{k-1}}{2}$$

and $$\frac{L_{k+1} + L_k}{2},$$

which is represented as a dot within the sub-color space squares corresponding to $L_k$. By way of example, the delta modulation values (di) used in the modulation cycle are set as: $d_1=0$, $d_2=-\delta$, $d_3=\delta$, $d_4=0$, $d_5=-2\delta$, and $d_6=2\delta$, where δ is a predefined delta value.

Referring to FIG. 7A. In this case, the color component of the pixel has a value greater than $$\frac{L_k + L_{k-1}}{2}$$

and less than $L_k$. That is, $$\frac{L_k + L_{k-1}}{2} < X_0 < L_k.$$

The color levels of the pixel color component in the 6 frames are determined as: $C_1=L_k$, $C_2=L_{k-1}$, $C_3=L_k$, $C_4=L_k$, $C_5=L_{k-1}$, and $C_6=L_k$. The average display color value $C_{avg}$ is equal to $(2L_{k-1}+4L_k)/6$, which is a color level between $L_{k-1}$ and $L_k$.

Referring to FIG. 7B. In this case, the color component of the pixel has a value equal to $L_k$. That is, $X_0=L_k$. The color levels of the pixel color component in the 6 frames are determined as: $C_1=L_k$, $C_2=L_k$, $C_3=L_k$, $C_4=L_k$, $C_5=L_{k-1}$, and $C_6=L_{k+1}$. As a result, the averaged color level $C_{avg}$ is equal to $(L_{k-1}+4L_k+L_{k+1})/6$, which is a color level equal to $L_k$.

Referring to FIG. 7C. In this case, the color component of the pixel has a value greater than $L_k$ and less than $$\frac{L_{k+1} + L_k}{2}.$$

That is, $$L_k < X_0 < \frac{L_{k+1} + L_k}{2}.$$

The color levels of the pixel color component in the 6 frames are determined as: $C_1=L_k$, $C_2=L_k$, $C_3=L_{k+1}$, $C_4=L_k$, $C_5=L_k$, and $C_6=L_{k+1}$ As a result, the average display color value $C_{avg}$ is equal to $(4L_k+2L_{k+1})/6$, which is a color level value between $L_k$ and $L_{k+1}$.

It can be observed from FIGS. 7A-7C that if the dithering is performed without applying the modulation, the color level of the color component of the pixel will be determined as $L_k$ for each of the frames. By applying the modulation, the color component of the pixel for the case in FIG. 7A, which has a value greater then $$\frac{L_k + L_{k-1}}{2}$$

and less than $L_k$, has an average display color value between $L_{k-1}$ and $L_k$ over the modulation cycle; the color component of the pixel for the case in FIG. 7B, which has a value equal to $L_k$, has an average display color value equal to $L_k$ over the modulation cycle; and the color component of the pixel for the case in FIG. 7C, which has a value greater than $L_k$ and less than $$\frac{L_{k+1} + L_k}{2},$$

has an average display color value between $L_k$ and $L_{k+1}$ over the modulation cycle. In other words, the display image is smoothened by applying the directional modulation therefore the observable degradation of color depth due to frame rate conversion can be eliminated.

In some embodiments, with the dithering and directional modulation-based frame rate conversion apparatus, an input image source having 60 Hz frame rate at color depth of 8 bits per component may be converted to an output image source with color depth of 2 bits per component displayed at 240 Hz frame rate, color depth of 3 bits per component displayed at 180 Hz frame rate or color depth of 4 bits per component displayed at 120 Hz frame rate.

The dithering and directional modulation-based frame rate conversion apparatus can be configured to support conversion of image sources (say, from a computer graphic card) having various frame rates. For example, an input image source having 60 Hz frame rate at color depth of 8 bits per component may be converted to an output image source with color depth of 2 bits per component displayed at 240 Hz frame rate, color depth of 3 bits per component displayed at 180 Hz frame rate or color depth of 4 bits per component displayed at 120 Hz frame rate.

In some embodiments, the output image source may have a mix of different display formats of frame rates including but not limited to, 240 Hz, 200 Hz, 180 Hz, 150 Hz, 120 Hz, 100 Hz, 80 Hz and 60 Hz. FIGS. 8A-8D shows how different input image sources are converted to different output image sources having mixes of different display formats.

Figure 8A:
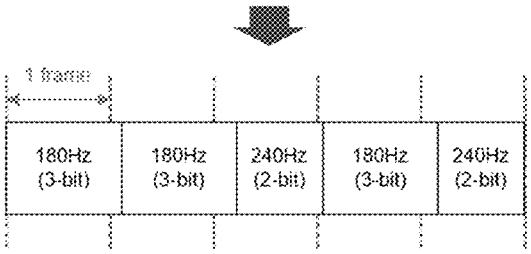
FIGS. 8A-8D shows how input image sources with different display formats are converted to output image sources with mixes of different display formats.

Referring to FIG. 8A. An input image source having 200 Hz frame rate at color depth of 8 bits per component may be converted to an output image source having a mix of color depth of 3 bits per component at 180 Hz frame rate and color depth of 2 bits per component at 240 Hz frame rate.

Figure 8B:
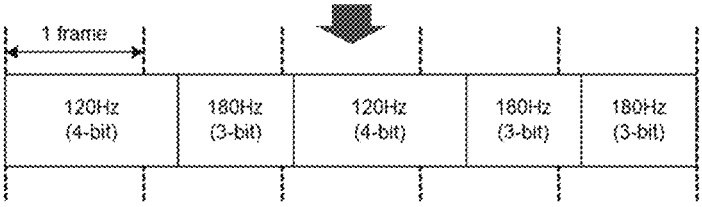

Referring to FIG. 8B. An input image source having 150 Hz frame rate at color depth of 8 bits per component may be converted to an output image source having a mix of color depth of 4 bits per component at 120 Hz frame rate and color depth of 3 bits per component at 180 Hz frame rate.

Figure 8C:
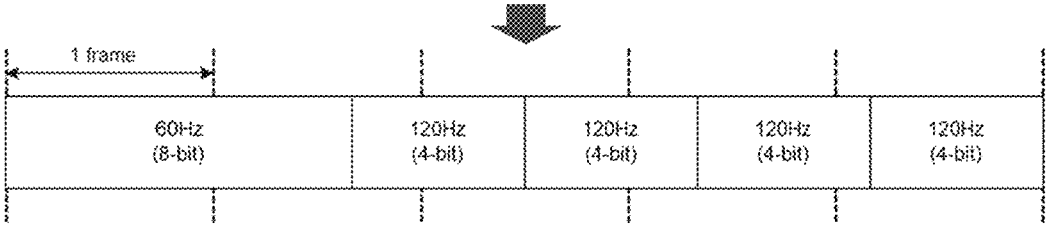

Referring to FIG. 8C. An input image source having 100 Hz frame rate at color depth of 8 bits per component may be converted to an output image source having a mix of color depth of 4 bits per component at 120 Hz frame rate and color depth of 8 bits per component at 60 Hz frame rate.

Figure 8D:
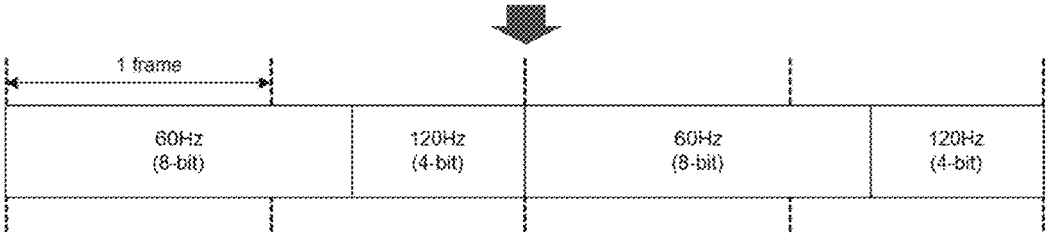

Referring to FIG. 8D. An input image source having 80 Hz frame rate at color depth of 8 bits per component may be converted to an output image source having a mix of color depth of 4 bits per component at 120 Hz frame rate and color depth of 8 bits per component at 60 Hz frame rate.

Figure 9:
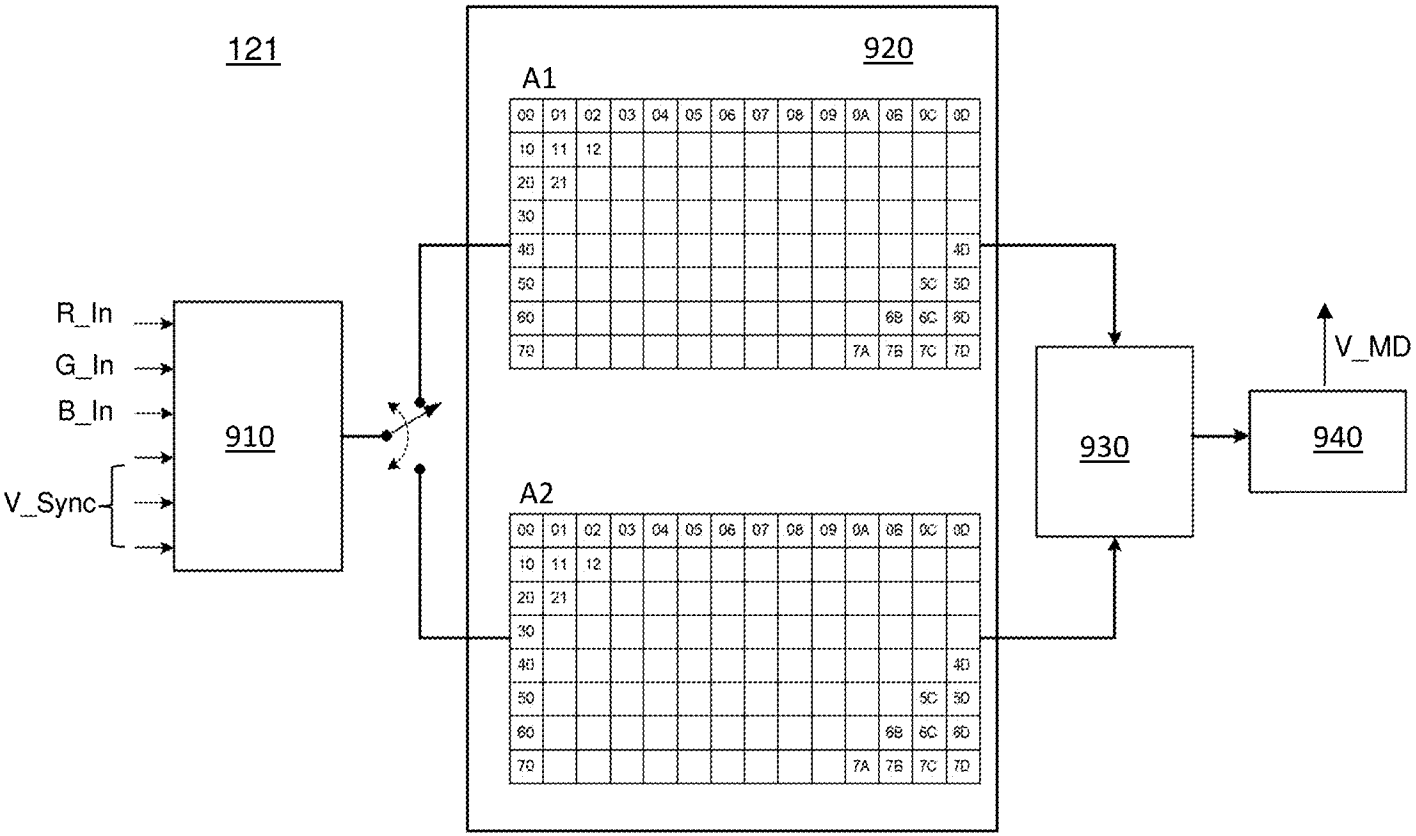
FIG. 9 shows a simplified block diagram of a dynamic motion detection apparatus according to one embodiment of the present invention.

FIG. 9 shows a simplified block diagram of the dynamic motion detecting apparatus 121 used in a display device according to one embodiment of the present invention. Referring to FIG. 9. The process of dynamic motion detection may include: a) partitioning, by a brightness accumulator 910, a display screen of the display device into a plurality of regions; b) calculating, by the brightness accumulator 910, a plurality of regional brightness values for a first frame; c) storing, by a storage unit 920, the regional brightness values of the first frame into a first brightness data array A1; d) calculating, by the brightness accumulator 910, a plurality of regional brightness values for a second frame which is ΔF frames after the first frame, where ΔF is an integer greater than 1 and preferably equal to 15; e) storing, by the storage unit 920, the regional brightness values of the second frame into a second brightness data array A2; f) comparing, by a brightness change detector 930, the first and second brightness data arrays A1, A2 to obtain an array of brightness differences; g) detecting, by the brightness change detector 930, change of brightness for each region of the display screen by comparing each element of the array of brightness differences with one or more voting threshold values; h) generating, by the brightness change detector 930, a vote based on a comparison result for each element of the array of brightness differences.

In some embodiments, the vote may have a first voting value for the element if the comparison result is that the element is equal to or lower than the first voting threshold value; a second voting value which is higher than the first voting value for the element if the comparison result is that the element is higher than the first voting threshold value and lower than the second voting threshold value; or a third voting value which is higher than the second voting value for the element if the comparison result is that the element is equal to or higher than the second voting threshold value.

The process of dynamic motion detection may further include: i) calculating, by a majority vote logic unit 940, a sum of the votes generated for all elements of the array of brightness differences; j) determining, by the majority vote logic unit 940, the motion detection result by comparing the calculated sum of the votes with one or more motion detection threshold values; and k) generating, by the majority vote logic unit 940, a motion detection signal (V_MD) to the frame rate controller 122 based on the motion detection result.

In some embodiments, if the calculated sum is equal to or higher than a motion detection threshold value, the motion detection result may be determined as that the video includes appreciable amount of motion contents. Based on the determined motion detection result, the frame rate controller 122 may determine to display the video with a lower color depth at a higher frame rate than the standard configuration of the display device (e.g., with a color depth of 4 bits per color components and at a frame rate of 120 Hz). If the calculated sum is smaller than the motion detection threshold value, the motion detection result may be determined as that the video is relatively static. Based on the determined motion detection result, the frame rate controller 122 may determine to display the video with a higher color depth at a lower frame rate than the standard configuration of the display device (e.g., with a color depth of 8 bits per color components and at a frame rate of 60 Hz).

A new round of dynamic motion detection may be performed by: taking a previous second frame in a previous round of motion detection as a new first frame for the new round of motion detection; calculating brightness values of a new second frame which is ΔF frames after the new first frame; overwriting the brightness data array which has stored brightness values of a previous first frame in the previous round of motion detection with the calculated brightness values for the new second frame; and repeating the above steps f) to k). As there is no need to calculate the brightness values for the new first frame, the computation time for new round of motion detection can be greatly reduced.

Figure 10:
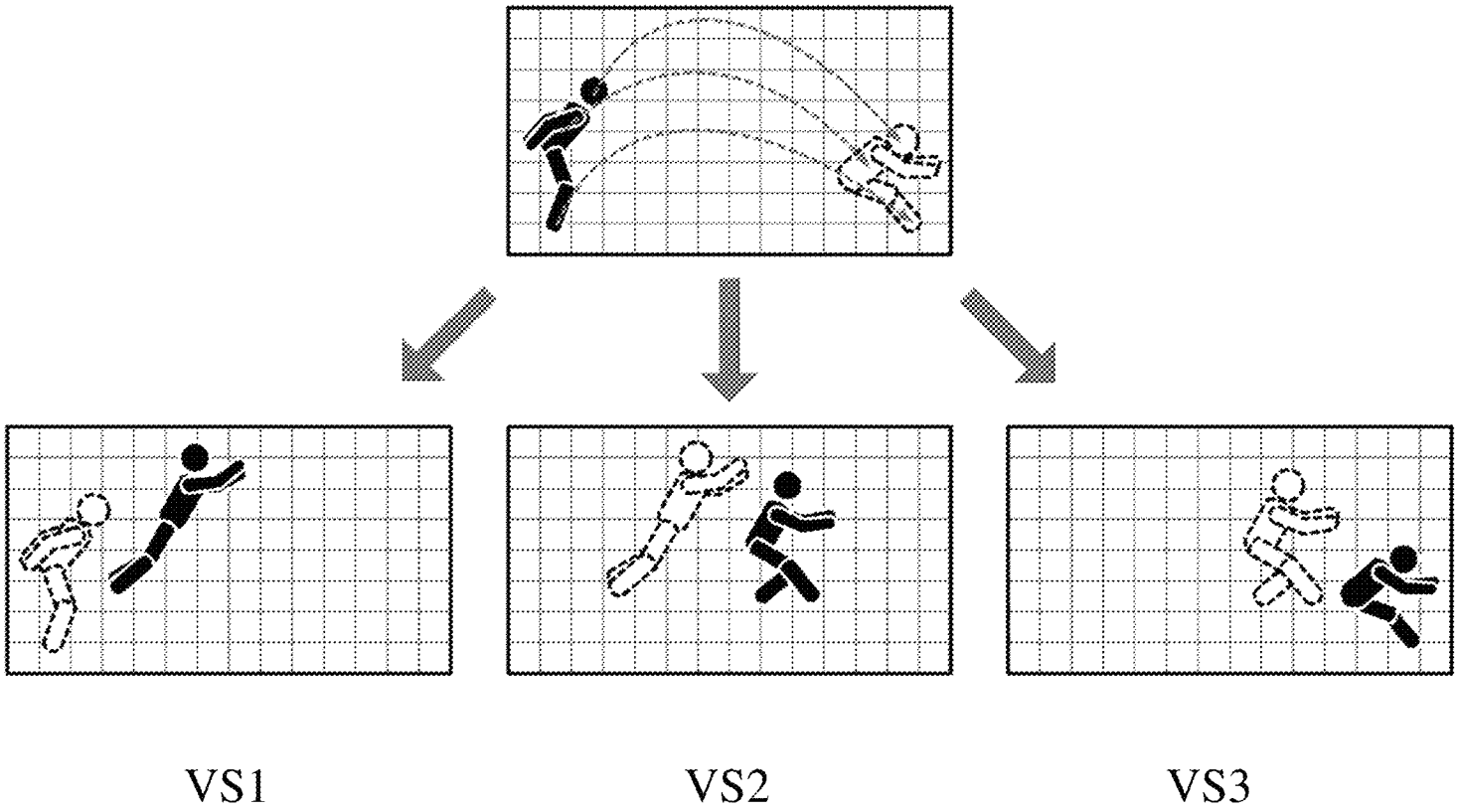
FIG. 10 illustrates how an exemplary video clip is divided into different video segments for dynamic motion detection.
Figure 11A:
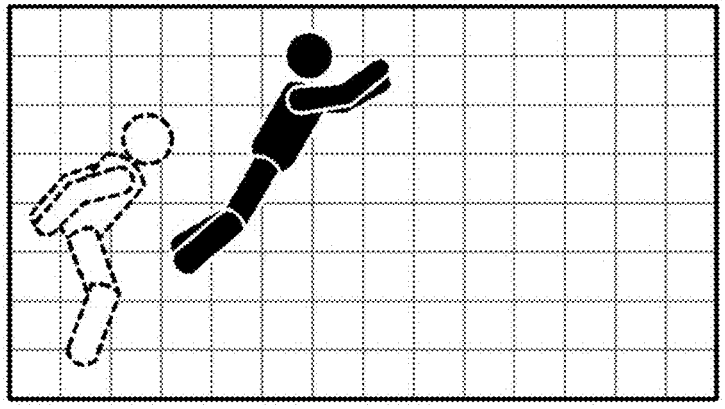
FIGS. 11A-11C illustrate how different display output formats are determined based on motion detection results for different video segments in the exemplary video clip.
Figure 11A:
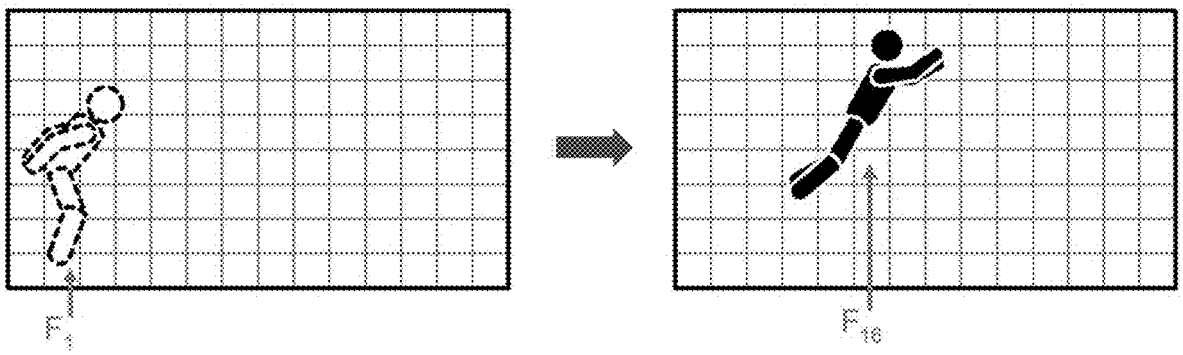
Figure 11B:
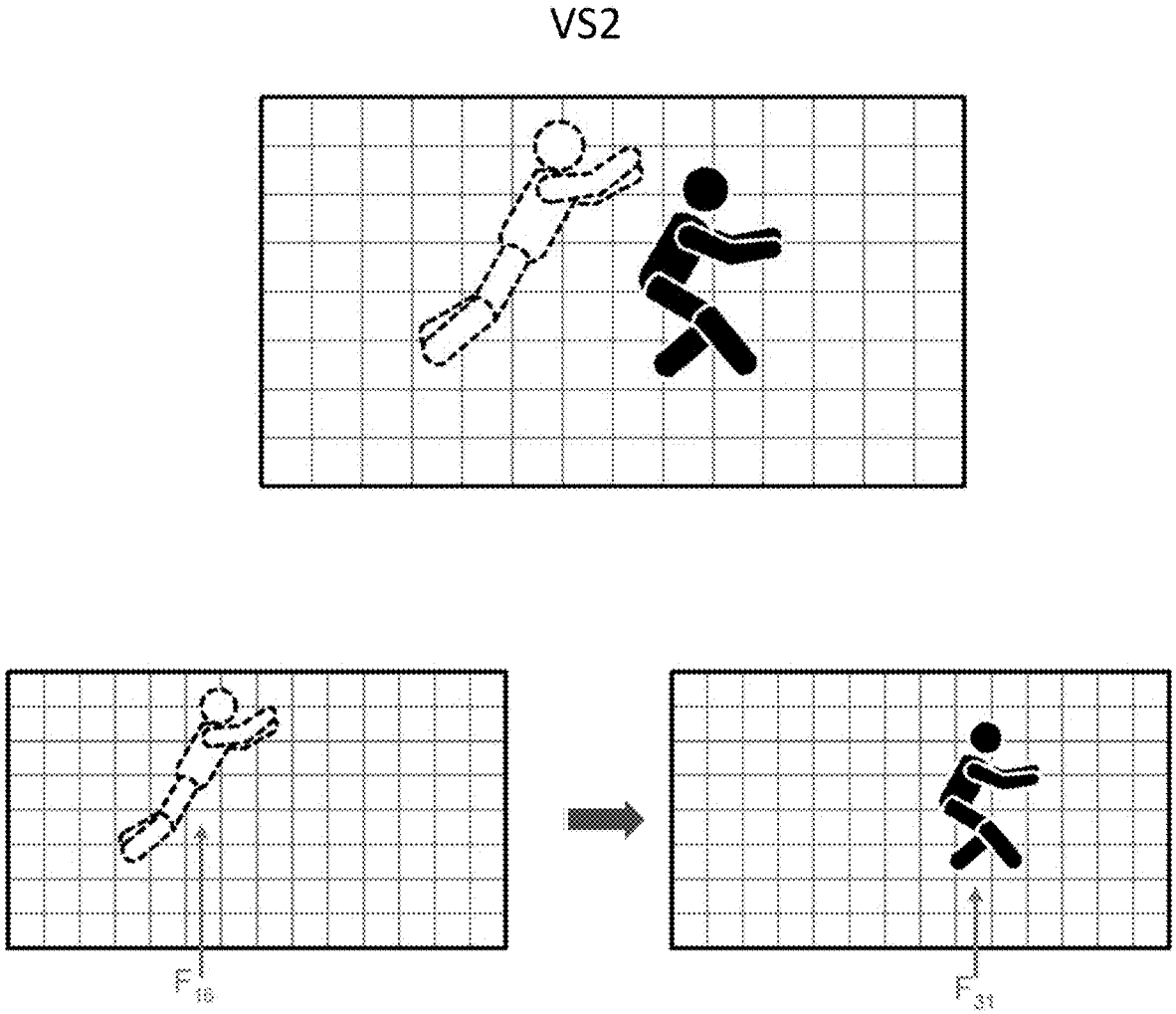
Figure 11C:
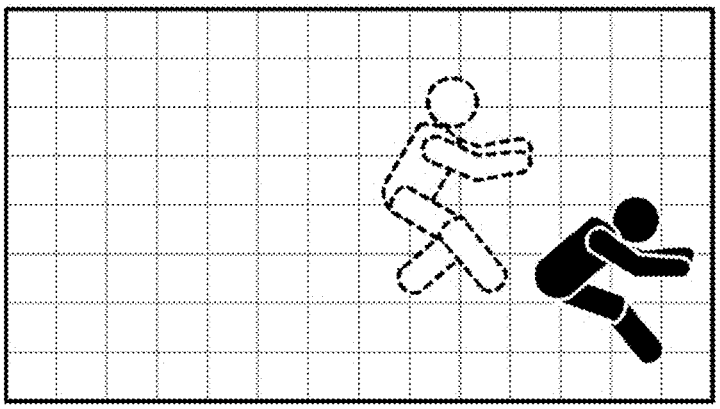
Figure 11C:
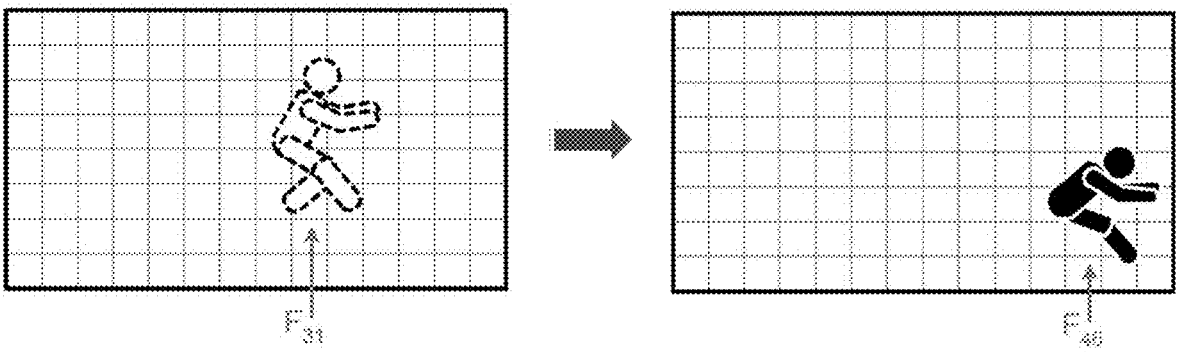

FIG. 10 illustrates how an exemplary video clip (displaying "a man jumping from left to right") is divided into different video segments for performing motion detections. FIGS. 11A-11C illustrate how different display output formats are determined based on motion detection for different video segments in the exemplary video clip.

Referring to FIG. 10, a display screen for displaying the exemplary video clip is partitioned into 14×8=112 regions. The exemplary video clip has an original frame rate of 120 Hz and a color depth of 8 bits per color component. The exemplary video clip is divided into three video segments VS1, VS2 and VS3 for motion detection. In each video segment, the second frame is 15 frames after the first frame.

Referring to FIG. 11A, the first frame and second frame for the video segment VS1 are denoted as $F_1$ and $F_{16}$, respectively. The brightness values of the 112 partitioned regions for frame $F_1$ are calculated and stored into a first 14×8 brightness data array A1. The brightness values of the 112 partitioned regions for frame $F_{16}$ are calculated and then stored in to a second 14×8 brightness data array A2. The first and second brightness data arrays A1, A2 are compared to obtain an 14×8 array of brightness differences, each corresponds to a partitioned region. For each region, a vote is generated to have: a first voting value "0" if the corresponding brightness difference is equal to or lower than a first voting threshold value, 5% for example, a second voting value "1" if the corresponding brightness difference is higher than the first voting threshold value 5% and lower than a second voting threshold value, 20% for example, or a third voting value "2" if the corresponding brightness difference is equal to or higher than the second voting threshold value 20%. Based on a sum calculated for all of the generated votes, a first motion detection result is determined, and a motion detection signal is generated and transmitted to the frame rate controller 1122. For example, if the calculated sum is smaller than a motion detection threshold value "100", based on the first motion detection result, the frame rate controller 122 may determine a display output format with a color depth of 8 bits per color component at a frame rate of 60 Hz.

Referring to FIG. 11B, the second frame for the previous video segment VS1 is taken as the first frame for the video segment VS2, therefore the first frame and second frame for the video segment VS2 are denoted as $F_{16}$ and $F_{31}$ (which is 15 frames after $F_{16}$), respectively. While keeping the brightness values of the 112 partitioned regions for frame $F_{16}$ in the second 14×8 brightness data array A2, the brightness values of the 112 partitioned regions for frame $F_{31}$ are calculated and then stored in to the first 14×8 brightness data array A1. Then, the first and second brightness data arrays A1, A2 are compared to obtain an 14×8 array of brightness differences, each corresponds to a partitioned region.

For each region, a vote is generated to have: a first voting value "0" if the corresponding brightness difference is equal to or lower than the first voting threshold value 5%, a second voting value "1" if the corresponding brightness difference is higher than the first voting threshold value 5% and lower than the second voting threshold value 20%, or a third voting value "2" if the corresponding brightness difference is equal to or higher than the second voting threshold value 20%. Based on a sum calculated for all of the generated votes, a second motion detection result is determined, and a motion detection signal is generated and transmitted to the frame rate controller 122. For example, if the calculated sum is equal to or greater than a motion detection threshold value "100", based on the second motion detection result the frame rate controller may determine a display output format with a color depth of 4 bits per color component at a frame rate of 120 Hz.

Referring to FIG. 11C, the second frame for the previous video segment VS2 is taken as the first frame for the video segment VS3, therefore the first frame and second frame for the video segment VS3 are denoted as $F_{31}$ and $F_{46}$ (which is 15 frames after $F_{31}$), respectively. While keeping the brightness values of the 112 partitioned regions for frame $F_{31}$ in the first 14×8 brightness data array A1, the brightness values of the 112 partitioned regions for frame $F_{46}$ are calculated and then stored in to the second 14×8 brightness data array A2. The first and second brightness data arrays A1, A2 are then compared to obtain an 14×8 array of brightness differences, each corresponds to a partitioned region. For each region, a vote is generated to have: a first voting value "0" if the corresponding brightness difference is equal to or lower than the first voting threshold value 5%, a second voting value "1" if the corresponding brightness difference is higher than the first voting threshold value 5% and lower than the second voting threshold value 20%, or a third voting value "2" if the corresponding brightness difference is equal to or higher than the second voting threshold value 20%. Based on a sum calculated for all of the generated votes, a third motion detection result is determined, and a motion detection signal is generated and transmitted to the frame rate controller 122. For example, if the calculated sum is equal to or greater than a motion detection threshold value "100", based on the third motion detection result, the frame rate controller 122 may determine a display output format a color depth of 4 bits per color components at a frame rate of 120 Hz.

The embodiments disclosed herein may be implemented using general purpose or specialized computing devices, computer processors, or electronic circuitries including but not limited to digital signal processors (DSP), application specific integrated circuits (ASIC), field programmable gate arrays (FPGA), and other programmable logic devices configured or programmed according to the teachings of the present disclosure. Computer instructions or software codes running in the general purpose or specialized computing devices, computer processors, or programmable logic devices can readily be prepared by practitioners skilled in the software or electronic art based on the teachings of the present disclosure. In some embodiments, the present invention includes computer storage media having computer instructions or software codes stored therein which can be used to program computers or microprocessors to perform any of the processes of the present invention. The storage media can include, but are not limited to ROMs, RAMs, flash memory devices, or any type of media or devices suitable for storing instructions, codes, and/or data.

The embodiments were chosen and described in order to best explain the principles of the invention and its working principle and practical application, thereby enabling others skilled in the art to understand the invention for various embodiments and with various modifications that are suited to the particular use contemplated. It is not intended to be exhaustive or to limit the invention to the precise forms disclosed. Many modifications and variations will be apparent to the practitioner skilled in the art.

The invention claimed is:

1. A dithering and directional modulation-based frame rate conversion apparatus, comprising:

a directional delta modulation generator configured to receive a plurality of input color data representing a plurality of input color components of an input pixel color and generate a plurality of modulated data for the plurality of input color data respectively; and a plurality of dithering modules configured to perform K-bit dithering conversion on the plurality of input color data respectively to generate a plurality of output color data for representing a plurality of output color components of an output pixel color with a color depth of K bits per component, where K is an integer equal to or great than 1, each of the dithering modules comprising:

a respective residue line buffer configured to track a residual error in dithering conversion to generate a respective residual data;

a respective adapter configured to receive a respective input color data, a respective modulated data from the directional delta modulation generator and the respective residual data, and adapt the respective input color data to generate a respective adapted color data by adding the respective input color data with the respective modulated data and the respective residual data; and a respective dithering engine configured to receive the respective adapted color data and compare the respective adapted color data against a $(2^K-1)$ number of dithering threshold values to generate a respective output color data with $2^K$ possible color levels.

2. The dithering and directional modulation-based frame rate conversion apparatus according to claim 1, wherein the directional delta modulation generator is configured to:

determine a respective modulation direction by comparing the respective input color data against a modulation threshold value and obtaining a respective flag value of modulation for the color component; and apply a respective delta modulation to the respective input color data based on the respective modulation direction to obtain a respective modulated data.

3. The dithering and directional modulation-based frame rate conversion apparatus according to claim 2, wherein the modulation threshold value is set as a half of a maximum component value of the input pixel color.

4. The dithering and directional modulation-based frame rate conversion apparatus according to claim 3, wherein the delta modulation is performed across a sequence of N image frames over a modulation cycle with a sequence of N delta modulation values to obtain a sequence of N modulated data respectively.

5. The dithering and directional modulation-based frame rate conversion apparatus according to claim 4, wherein an $i^{th}$ modulated data obtained in an $i^{th}$ image frame in the modulation cycle is given by:

$$X_{mi}=X_{oi}+d_i, \text{ for } i=1, 2, \ldots, N,$$

where $X_{mi}$ is the $i^{th}$ modulated data obtained in the $i^{th}$ image frame, $X_{oi}$ is an original value of the respective input color data in the $i^{th}$ image frame, $d_i$, is a delta modulation value used in the $i^{th}$ image frame, and N is the total number of image frames over the modulation cycle.

6. The dithering and directional modulation-based frame rate conversion apparatus according to claim 5, wherein the sequence of N delta modulation values is selected to have a sum equal to zero.

7. The dithering and directional modulation-based frame rate conversion apparatus according to claim 6, wherein the respective dithering engine is further configured to determine, based on the sequence of N modulated data, a N number of modulated color levels across the N number of image frames respectively.

8. The dithering and directional modulation-based frame rate conversion apparatus according to claim 7, wherein an $i^{th}$ modulated color level determined in the $i^{th}$ image frame is given by:

$$C_i = \begin{cases} L_{K-1}, \text{ if } X_{mi} < \dfrac{L_K + L_{K-1}}{2} \\ L_k, \text{ if } \dfrac{L_k + L_{k-1}}{2} < X_{mi} < \dfrac{L_{k+1} + L_k}{2} \\ L_{K+1}, \text{ if } X_{mi} > \dfrac{L_{K+1} + L_K}{2} \end{cases}, \text{ for } i = 1, 2, \ldots, N$$

where $C_i$ is the $i^{th}$ color level determined in the $i^{th}$ image frame, $L_k$ is the $k^{th}$ color levels defined in the color space with the color depth of K bits per component.

9. The dithering and directional modulation-based frame rate conversion apparatus according to claim 8, wherein the respective dithering engine is further configured to:

average the N number of modulated color levels to obtain an average display color value; and set the average display color value as the color level for the respective output color data.

10. A frame rate convertible active matrix display device comprising the dithering and directional modulation-based frame rate conversion apparatus according to claim 1.

11. A dithering and directional modulation-based frame rate conversion method, comprising:

receiving, by a directional delta modulation generator, a plurality of input color data representing a plurality of input color components of an input pixel color;

generating, by the directional delta modulation generator, a plurality of modulated data for the plurality of input color data respectively;

performing, by a plurality of dithering modules, K-bit dithering conversion on the plurality of the input color data respectively to generate a plurality of output color data for representing a plurality of output color components of an output pixel color with a color depth of K bits per component, where K is an integer equal to or great than 1;

wherein each K-bit dithering conversion comprises:

tracking, by a respective residue line buffer, a respective residual error in dithering conversion to generate a respective residual data;

adapting, by a respective adapter, the respective input color data to generate a respective adapted color data by adding the respective input color data with the respective modulated data and the respective residual data; and comparing, by a respective dithering engine, the respective adapted color data against a $(2^K-1)$ number of dithering threshold values to generate a respective output color data with $2^K$ possible color levels.

12. The dithering and directional modulation-based frame rate conversion method according to claim 11, further comprising:

determining, by the directional delta modulation generator, a respective modulation direction by comparing the respective input color data against a modulation threshold value and obtaining a respective flag value of modulation for the color component; and applying, by the directional delta modulation generator, a respective delta modulation to the respective input color data based on the respective modulation direction to obtain a respective modulated data.

13. The dithering and directional modulation-based frame rate conversion method according to claim 12, wherein the modulation threshold value is set as a half of a maximum component value of the input pixel color.

14. The dithering and directional modulation-based frame rate conversion method according to claim 13, wherein the delta modulation is performed across a sequence of N image frames over a modulation cycle with a sequence of N delta modulation values to obtain a sequence of N modulated data respectively.

15. The dithering and directional modulation-based frame rate conversion method according to claim 14, wherein an $i^{th}$ modulated data obtained in an $it^h$ image frame in the modulation cycle is given by:

$$X_{mi}=X_{oi}+d_i, \text{ for } i=1, 2, \ldots, N,$$

where $X_{mi}$ is the $i^{th}$ modulated data obtained in the $i^{th}$ image frame, $X_{oi}$ is an original value of the respective input color data in the $i^{th}$ image frame, $d_i$, is a delta modulation value used in the $i^{th}$ image frame, and N is the total number of image frames over the modulation cycle.

16. The dithering and directional modulation-based frame rate conversion method according to claim 15, wherein the sequence of N delta modulation values is selected to have a sum equal to zero.

17. The dithering and directional modulation-based frame rate conversion method according to claim 16, further comprising determining, by a respective dithering engine, based on the sequence of N modulated data, a N number of modulated color levels across the N number of image frames respectively.

18. The dithering and directional modulation-based frame rate conversion method according to claim 17, wherein an $i^{th}$ modulated color level for of the respective input color data obtained in the $i^{th}$ image frame is given by:

$$C_i = \begin{cases} L_{K-1}, \text{ if } X_{mi} < \dfrac{L_K + L_{K-1}}{2} \\ L_k, \text{ if } \dfrac{L_k + L_{k-1}}{2} < X_{mi} < \dfrac{L_{k+1} + L_k}{2} \\ L_{K+1}, \text{ if } X_{mi} > \dfrac{L_{K+1} + L_K}{2} \end{cases}, \text{ for } i = 1, 2, \ldots, N,$$

where $C_i$, is the $i^{th}$ color level determined in the $i^{th}$ image frame, $L_k$ is the $k^{th}$ color levels defined in the color space with the color depth of K bits per component to be displayed.

19. The dithering and directional modulation-based frame rate conversion method according to claim 18, further comprising:

averaging, by the respective dithering engine, the Nnumber of modulated color levels to obtain an average display color value; and setting the average display color value as the color level for the respective output color data.

* * * * *